US005361690A

United States Patent [19]

Hsu

[11] Patent Number: 5,361,690

[45] Date of Patent: Nov. 8, 1994

[54] CAN CRUSHER

[76] Inventor: Ching-Ho Hsu, 9F, No. 107, Sec. 2, Roosevelt Rd., Taipei City, Taiwan, Prov. of China

[21] Appl. No.: 90,947

[22] Filed: Jul. 13, 1993

[51] Int. Cl.[5] ..... B30B 9/32; B30B 15/18

[52] U.S. Cl. ..... 100/48; 100/125; 100/269 R; 100/902

[58] Field of Search ..... 100/48, 125, 269 R, 100/902

[56] References Cited

U.S. PATENT DOCUMENTS

| | | | |
|---|---|---|---|
| 137,349 | 4/1873 | Dickinson | 100/125 X |
| 219,555 | 9/1879 | Woolson | 100/269 R X |
| 1,809,615 | 6/1931 | Wilson | 100/269 R X |
| 2,473,694 | 6/1949 | Renick | 100/269 R X |
| 2,501,527 | 3/1950 | Levinsohn et al. | 100/269 R |
| 4,686,897 | 8/1987 | Frank | 100/269 R X |
| 4,860,646 | 8/1989 | Spiers | 100/48 |
| 5,182,988 | 2/1993 | Styfhoorn | 100/125 X |

FOREIGN PATENT DOCUMENTS

| | | | |
|---|---|---|---|
| 362597 | 12/1938 | Italy | 100/269 R |
| 53143 | 9/1942 | Netherlands | 100/269 R |
| 187930 | 2/1964 | Sweden | 100/269 R |
| 813379 | 5/1959 | United Kingdom | 100/269 R |
| 967855 | 10/1982 | U.S.S.R. | 100/269 R |

*Primary Examiner*—Stephen F. Gerrity
*Attorney, Agent, or Firm*—Bacon & Thomas

[57] ABSTRACT

A can crusher for environmental protection is generally composed of a hydraulic pump to drive a piston, upwardly or downwardly. When the piston is driven downwardly, a plate is driven downwardly to crush a can. A groove is formed at an inner bottom portion to drain any residues left in the can to a collecting pan.

7 Claims, 7 Drawing Sheets

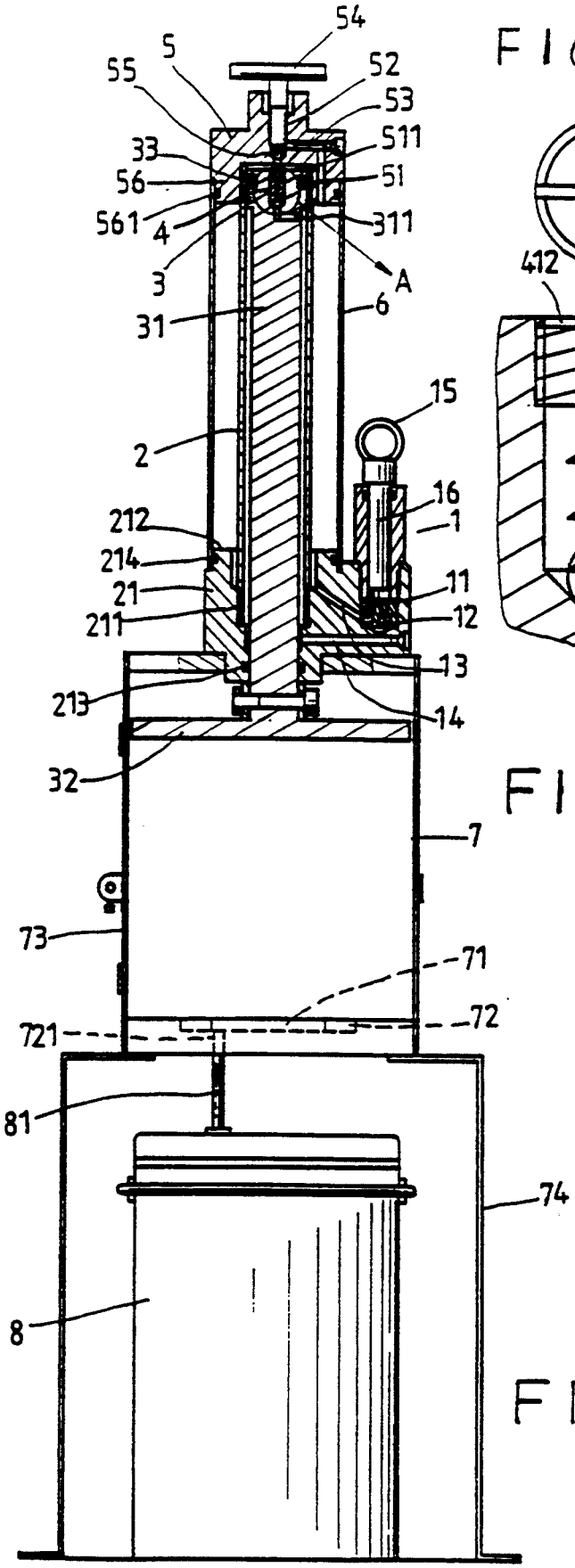
FIG. 2A
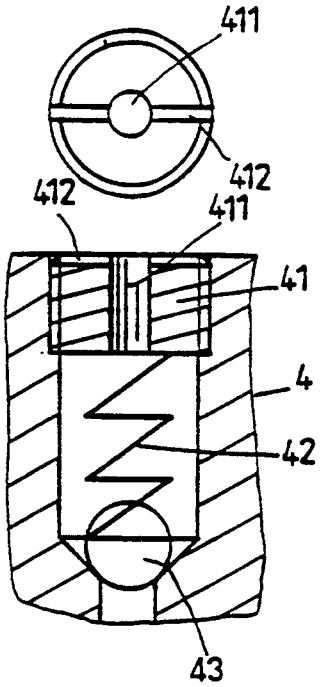
FIG 2C
FIG. 2B

CAN CRUSHER

FIELD OF THE INVENTION

This invention relates to an environmentally protective can crusher, more particularly, a crusher to crush cans and to collect all residues left therein.

BACKGROUND OF THE INVENTION

People are paying more attention to environmental protection than ever before since the natural resources of this land are gradually decreasing. Further, the amount of waste produced by humans is enormous and can hardly be disposed of. Thus, reusable products are the major consideration for all manufacturers, such as aluminum products.

However, people usually crush aluminum products, such as soft drink cans, either by hand or by foot which drains the residue directly onto the ground and causes contamination.

The inventor, in view of this, has invented the present invention which corrects the above-mentioned problem.

SUMMARY OF THE INVENTION

It is the primary object of the present invention to provide a can crusher which uses hydraulic power to crush cans.

It is another object of the present invention to provide a can crusher which is able to collect all residues left in the crushed can.

It is a further object of the present invention to provide a can crusher which is easy to operate.

It is still a further object of the present invention to provide a can crusher which is safe to operate.

BRIEF DESCRIPTION OF THE DRAWINGS

FIG. 2A is a side view of FIG. 1, partially sectioned;

FIG. 2B is an enlarged view of a pressure control valve taken from circle A in FIG. 2A;

FIG. 2C is a partial top view of the pressure control valve in FIG. 2B.

DETAILED DESCRIPTION OF THE PREFERRED EMBODIMENT

Figure 1:
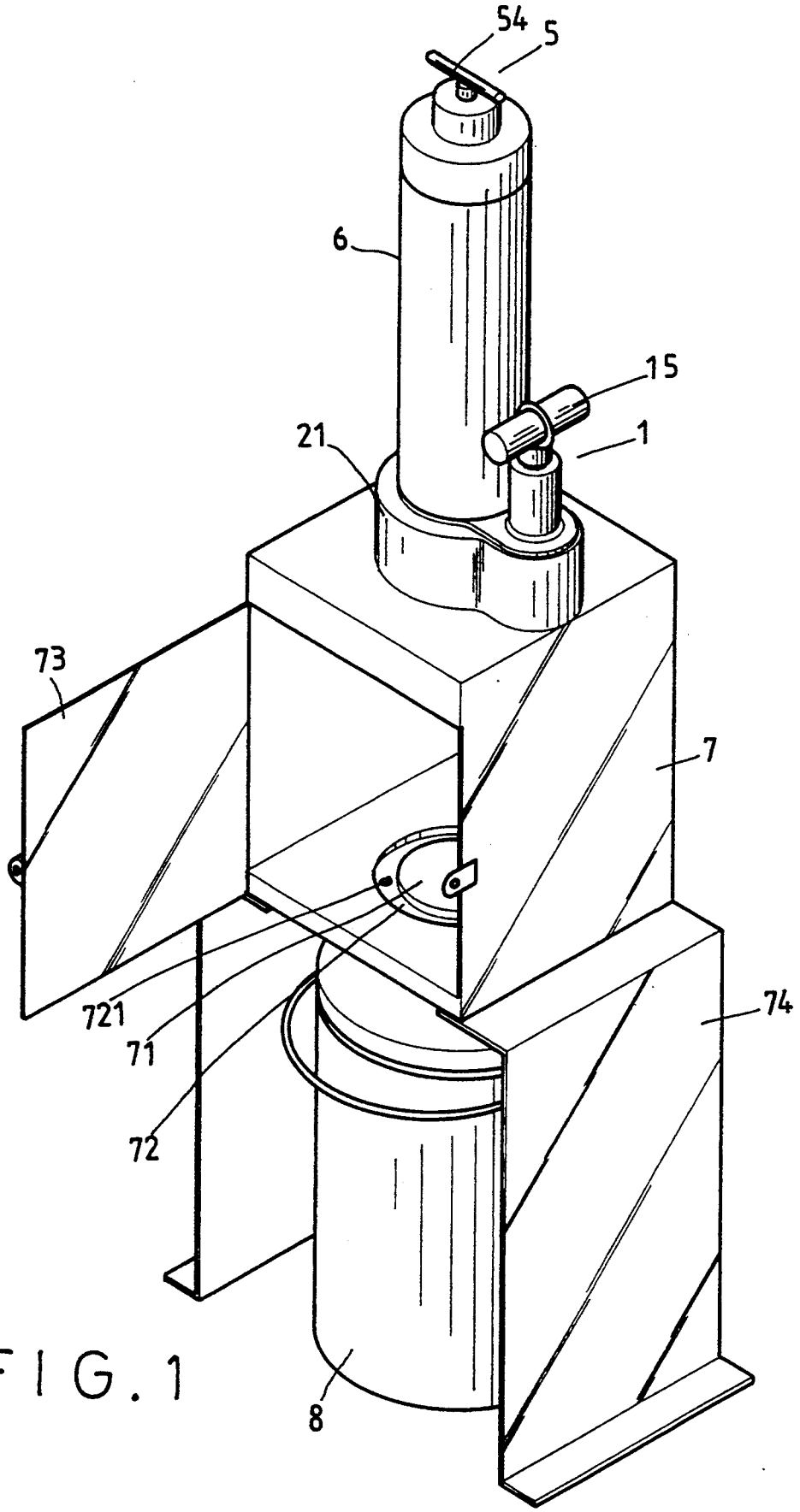
FIG. 1 is a perspective view of the present invention.

Reference is now made to the drawings which are for the purpose of illustrating a preferred embodiment only and not for the purpose of limiting the same. FIGS. 1, 2 show the present invention and which includes essentially a manually operated pump 1, a cylinder 2, a cylinder piston 3 adapted to move in cylinder 2, a pressure adjustment valve 4, a control valve 5, a hydraulic oil tank 6, a can receiving box 7, and an oil collecting barrel 8.

The pump 1 has two check valves 11, 12 operating in opposite ways, two pipelines 13, 14 having one end of each connected to one of the two check valves 11, 12 and the other end to the hydraulic oil tank 6 and the cylinder 2, respectively. A handle 15 located on top thereof is connected to a piston 16.

The cylinder 2 is located in an aperture 211 of base 21 which includes a reduced portion 21 2 outside the aperture 211. Two oil seals 213, 214 are inserted into the reduced portion 212 and the aperture 211 for preventing oil leakage.

The cylinder piston 3 is also sealed with oil seal 33 to prevent oil leakage from the cylinder 2. The bottom portion of the cylinder piston 3 has a piston rod 31 extending through the aperture 211 and into the base 21.

Piston rod 31 has a bore 311 adopted to communicate with the pressure adjustment valve 4.

The pressure adjustment valve 4, according to FIGS. 2B and 2C, is composed of a block 41 on top having an aperture 411 at its center and male threads 412 which are adapted to adjust the tension of a spring 42. The spring 42 urges a ball 43 downward to seat on top of the bore 311 to either close or to open the bore 311.

The control valve 5 includes a groove 51 which forms a clearance 511 between the groove 51 and the cylinder piston 3 when the cylinder piston 3 moves to its top position. At the top center there is a female threaded hole 52 which has a passage 53 at one side which communicates with the hydraulic oil tank 6. Valve 54 is threadedly inserted into the female threaded hole 52 and engages a ball 55 thereof. The ball 55 engages the passage 53 which will be blocked by the ball 55 when the valve 54 is threaded to the tightest position. An oil seal 561 is inserted into a reduced portion 56 of the control valve 5 to prevent oil leakage.

The hydraulic oil tank 6 sleeves on reduced portions 56, 212 of the control valve 5 and the base 21, respectively.

The can receiving box 7 is securely affixed to the base 21 and has a dented can receiving area 71 at an inner bottom portion with an oil collecting groove 72 surrounding the can receiving area 71. A drain 721 has one end communicates with the oil collecting groove 72 and the other end communicates with the oil collecting barrel 8. A door 73 is adapted to close the receiving box 7 in order to prevent oil from spilling out when the can is crushed. A frame 74 is also adapted to sustain the oil collecting box 7 to stand firmly.

Figure 3:
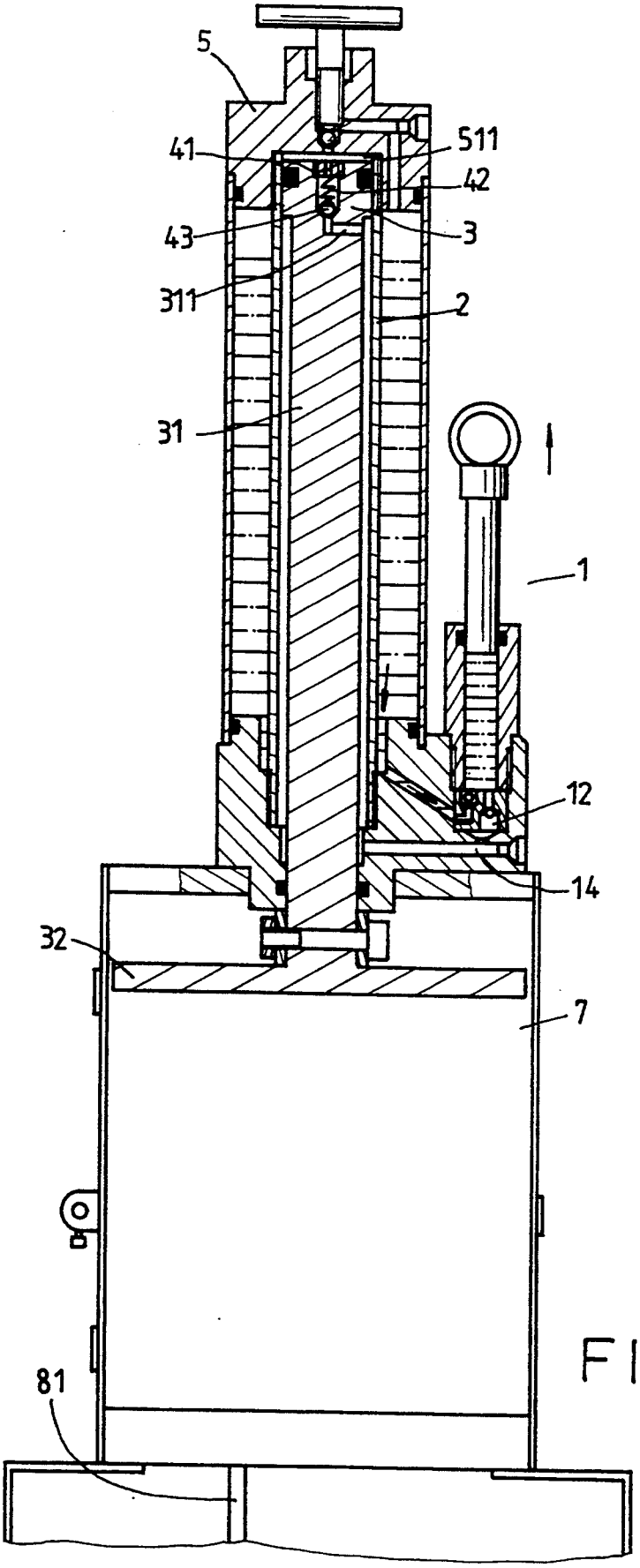
FIG. 3 is a side view of the device of FIG. I showing the pump handle pulled upward.
Figure 4:
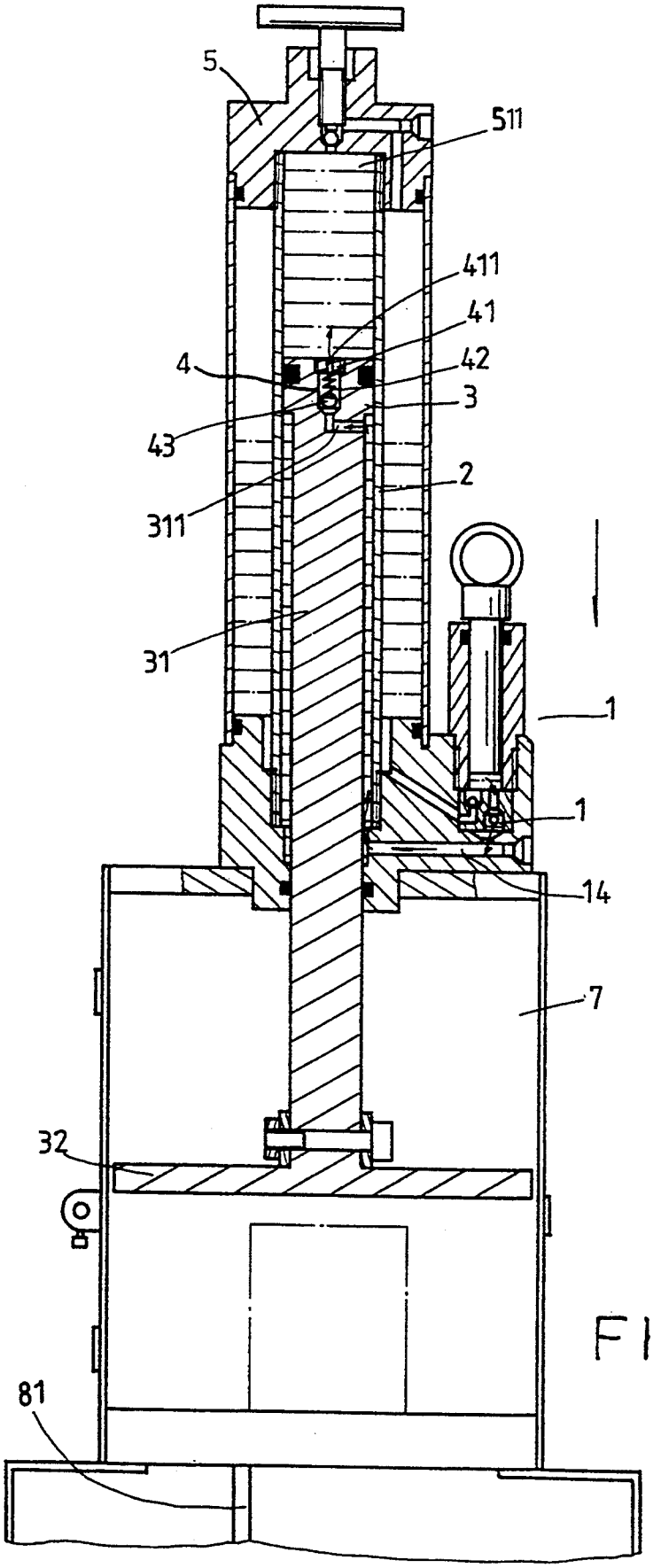
FIG. 4 is a side view of the device of FIG. 3, showing the pump handle pushed downward.
Figure 5:
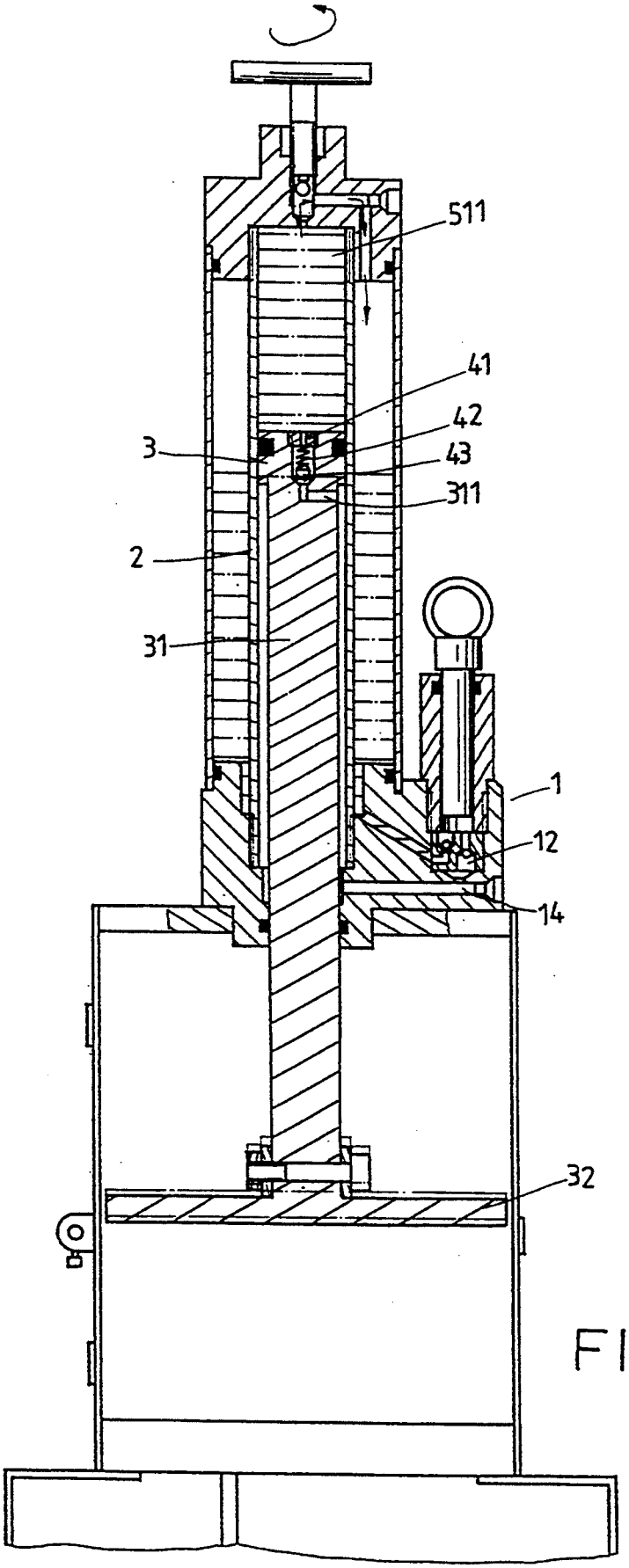
FIG. 5 is a side view of the device in FIGS. 3 and 4 illustrating the opening of the control valve and the hydraulic oil flow direction.
Figure 6:
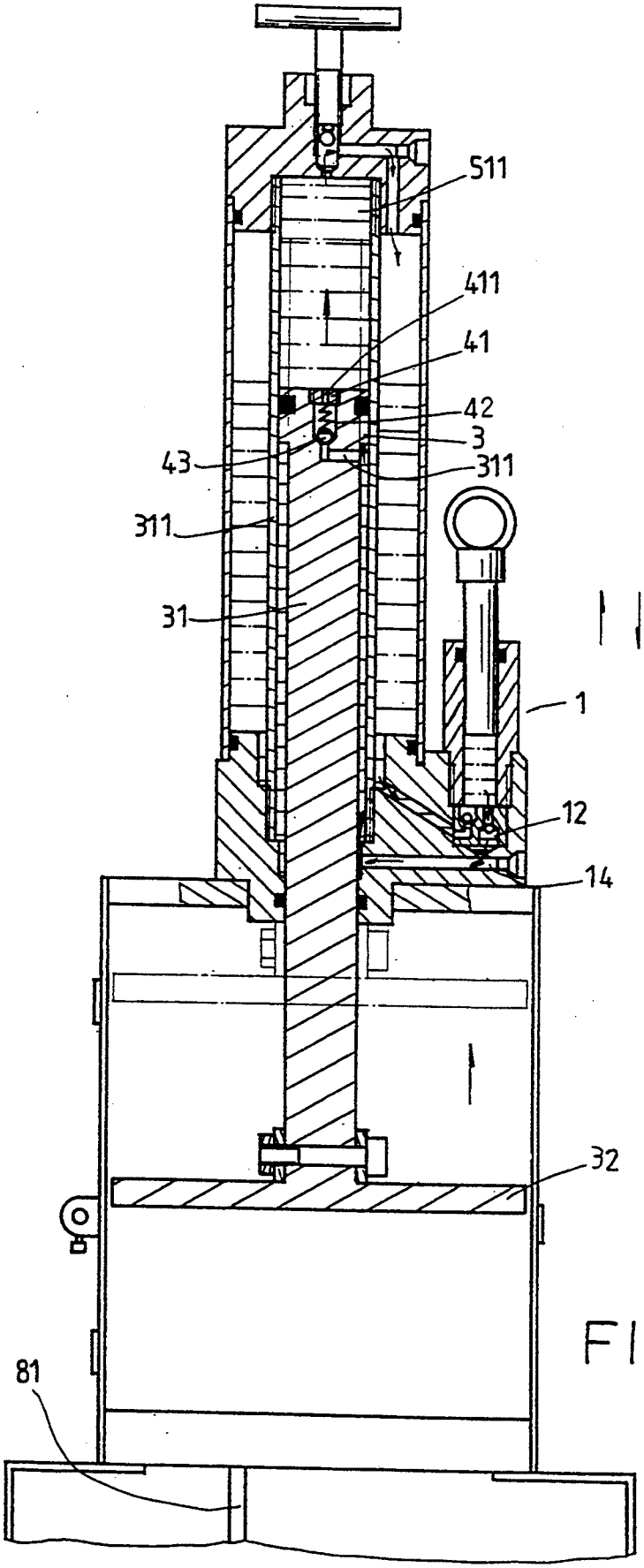
FIG. 6 is a side view of the device of FIG. 5 illustrating the manually controlled pump in operation.
Figure 7:
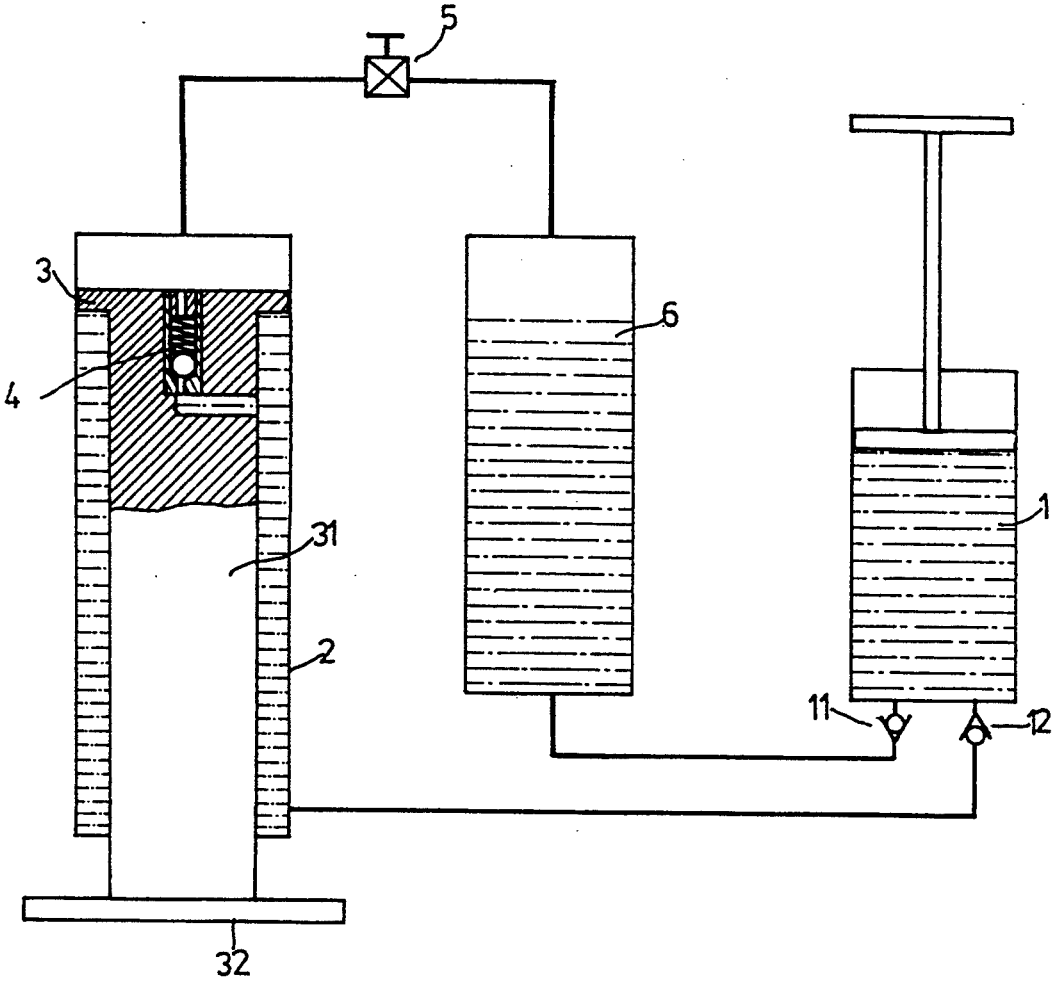
FIG. 7 is a hydraulic flow chart of the present invention.

To operate the crusher, according to FIGS. 3, 4, and FIG. 7 the valve 54 is closed which brings ball 55 downward to close the passage 53. Air is expelled from the cylinder 2, so that the interior of the pump is in vacuum status. Then, handle 15 is pulled upwardly which brings the piston 16 in the same direction. This will suck hydraulic oil in the hydraulic oil tank 6 into the pump 1 through the check valve 11. Then, as handle 15 is pushed downward, hydraulic oil is forced out through check valve 12 into the cylinder 2. The hydraulic oil in the cylinder 2 will push the cylinder piston 3 upward until the spring 42 is overcome and the ball 43 is pushed upwardly, then the hydraulic oil will flow through the chamber of the cylinder 2, the bore 311 of the piston rod 31, the aperture 411 of the block 41, and into the clearance 511 between the cylinder piston 3 and the control valve 5. The hydraulic oil, then, pushes the cylinder piston 3, the piston rod 31 and the plate 32 downward. By continuing operation the handle 15, the can in the receiving box 7 is crushed. The liquid residue in the can is collected by the oil collecting barrel 8 through drain 721.

Upon the task completion, simply release the threadedly tightened valve 54 the ball 55 is moved upward to open the passage 53 which allows hydraulic oil flow into the hydraulic oil tank 6 through the control valve 5. When the hydraulic oil in the cylinder 2 has reached a level that the pressure against the cylinder piston 3 from top and from bottom is even, the spring 42 will push the ball 43 downward and close the passage 53.

In case a can to be crushed is made of hardened material, simply adjust the male threads 412 of the pressure adjustment valve 4 to move downward. This will cause the spring 42 to push the ball 43 with more force, and therefore,, require more hydraulic oil pressure to operate the cylinder piston 3.

I claim:

1. A manually operable, hydraulic can crusher comprising:

a support for supporting a can to be crushed;

a hydraulic cylinder having a hydraulic oil inlet and a hydraulic oil outlet;

a tank for holding hydraulic oil;

a manually operable pump having two check valves, one check valve controlling hydraulic oil flow between said hydraulic oil tank and the pump and a second check valve controlling hydraulic oil flow between the pump and the hydraulic oil inlet of the hydraulic cylinder;

a cylinder piston movably received in said hydraulic cylinder, said cylinder piston having a passage therethrough at a center portion for permitting hydraulic oil flow between opposing sides of said cylinder piston within said hydraulic cylinder;

a crushing plate attached to the cylinder piston;

a pressure adjustment valve received within said passage in said cylinder piston for adjusting the hydraulic oil flow through said cylinder piston passage; and an openable and closeable control valve within the hydraulic oil outlet of said hydraulic cylinder for controlling hydraulic oil flow between said cylinder and said hydraulic oil tank, whereby when said control valve is closed, said manually controlled pump is adapted to pump hydraulic oil into said cylinder and through said pressure adjustment valve to move said cylinder piston to cause said crushing plate to move so as to crush a can located under said crushing plate and when said control valve is opened said manually controlled pump is adapted to pump hydraulic oil out of said cylinder and through said control valve to move said control piston to cause said crushing plate to move away from the crushed can.

2. The can crusher of claim 1, wherein said two check valves of said manual control pump are oriented so as to permit hydraulic oil flow in opposite directions.

3. The can crusher of claim 1, wherein said pressure adjustment valve comprises;

a block defining an aperture therethrough at a center thereof threadingly engaged with said piston;

a ball located over said cylinder piston passage; and, a spring extending between the ball and the block such that rotation of the block adjusts the tension of the spring whereby said spring urges the ball downward to seat on the cylinder piston passage.

4. The can crusher of claim 1, wherein said cylinder piston is sized so as to be slidably engaged with said cylinder.

5. The can crusher of claim 1, wherein said control valve defines a groove in a bottom portion to form a clearance with said cylinder piston, a female threaded hole at a center portion thereof, said female threaded hole including a control valve passage for permitting hydraulic oil flow between said cylinder and said hydraulic oil tank and further comprising:

a movable ball in said female threaded hole; and, a threaded handle engaging the female threaded hole and contacting the ball whereby rotation of said handle permits the ball to open and close the female threaded hole.

6. The can crusher of claim 1, further comprising a base defining a reduced portion on which said hydraulic cylinder sits and an oil seal inserted into said reduced portion of said base to prevent oil leakage.

7. The can crusher of claim 1, wherein said can support includes;

a can receiving box, the receiving box having a can receiving area adapted to seat a can thereon, and a liquid collecting groove surrounding said can receiving area;

a collecting barrel;

a drain communicating between the groove and the collecting barrel to drain out liquid waste into the collecting barrel; and a frame provided to support said receiving box.

* * * * *